US005803155A

United States Patent [19]

Lavazza et al.

[11] Patent Number: 5,803,155

[45] Date of Patent: Sep. 8, 1998

[54] CASTING LINE FOR SLABS

[75] Inventors: Alfredo Lavazza, Solbiate Olona; Andrea Carboni, Milan; Giovanni Coassin, Pordenone, all of Italy

[73] Assignee: Danieli & C. Officine Meccaniche SpA, Buttrio, Italy

[21] Appl. No.: 646,017

[22] Filed: May 7, 1996

[30] Foreign Application Priority Data

May 18, 1995 [IT] Italy ..... UD95A0090

[51] Int. Cl.[6] ..... B22D 11/04; B22D 11/16

[52] U.S. Cl. ..... 164/417; 164/424; 164/452; 164/476

[58] Field of Search ..... 164/417, 476, 164/452, 424

[56] References Cited

U.S. PATENT DOCUMENTS

| | | | |
|---|---|---|---|
| 4,043,382 | 8/1977 | Saito et al. | 164/476 |
| 4,955,428 | 9/1990 | Schrewe | 164/424 X |
| 4,976,306 | 12/1990 | Pleschiutschnigg et al. | 164/476 |
| 5,018,569 | 5/1991 | Burau et al. | 164/477 X |
| 5,497,821 | 3/1996 | Arvedi et al. | 164/476 |
| 5,577,548 | 11/1996 | Hohenbichler et al. | 164/476 X |

FOREIGN PATENT DOCUMENTS

| | | | |
|---|---|---|---|
| 0329639 | 8/1989 | European Pat. Off. . | |
| 0450391 | 10/1991 | European Pat. Off. . | |
| 0539.784 | 5/1993 | European Pat. Off. . | |
| 0625 388 | 11/1994 | European Pat. Off. . | |
| 2652020 | 3/1991 | France | 164/476 |
| 63-215353 | 9/1988 | Japan | 164/476 |
| 63-242452 | 10/1988 | Japan | 164/452 |
| 1-271047 | 10/1989 | Japan | 164/476 |
| 5-69088 | 3/1993 | Japan | 164/476 |

*Primary Examiner*—J. Reed Batten, Jr.

*Attorney, Agent, or Firm*—Antonelli, Terry, Stout & Kraus, LLP

[57] ABSTRACT

The casting line for slabs comprises at least a mould (11), an assembly of foot rolls (12) located at the outlet of the mould (11), a plurality of containing and guide assemblies (13) associated with the vertical segment of the line, a possible extraction assembly cooperating downstream with the last containing and guide assembly (13) and a drawing assembly (16) associated with the horizontal segment of the line, the containing and guide assemblies (13) covering at least the whole vertical segment of the casting line, at least part of the rolls (14) of the containing and guide assemblies (13) cooperating with an actuator (19) governed by a data processing unit (20) to obtain a controlled soft-reduction pre-rolling at least in the second part of the vertical segment of the casting line.

5 Claims, 2 Drawing Sheets

STATE OF THE ART

CASTING LINE FOR SLABS

BACKGROUND OF THE INVENTION

This invention concerns a vertical casting line for slabs, and in particular, for thin and medium sized slabs.

To be more exact, the invention concerns an improved vertical casting line, which makes possible an increase of the versatility of the plant and at the same time improves the internal and surface quality of the cast product.

The state of the art covers continuous casting plants prearranged with a vertical casting line to cast slabs continuously and, to be more exact, to cast medium sized and thin slabs.

The most developed state of the art in this field is shown in FIG. 1.

The continuous casting machines 100 of the state of the art comprise a mould 101, which acts as a former for the cast product 108 and is associated downstream with an assembly of foot rolls 102 that contain the product 108 emerging.

The height "a" of the mould, depending on the type of product, on the material and on other working parameters, is, for example, about 1000 to 1400 mm., whereas the height "b" of the foot roll assembly 102 is about 600 to 800 mm.

The foot rolls can be replaced by plates or other containing elements having the same purpose.

Downstream of the foot roll assembly 102 are included in sequence a plurality of containing and guide assemblies 103, each of which comprises stationary rotary rolls 104 generally of a small diameter and able to limit the product 108 laterally during its descent and progressive solidification.

The containing and guide assemblies 103 normally cooperate with secondary cooling means which speed up completion of the process of solidification of the cast product 108.

In the example shown the containing and guide assemblies 103 as a whole cover a height "c" of about 5200 to 5600 mm.

An extraction assembly 105, which is typically of a pinch-roll type, is included in prolongation of the containing and guide assemblies 103 in the vertical segment of the casting line; the rolls of the extraction assembly 105 grip with a given pressure the cast product 108 and accompany it in the curvature with which the product takes on a substantially horizontal trajectory.

The height "e" of the extraction assembly 105 is, in the example shown, about 3600 to 4000 mm.

A drawing assembly 106 is located in the horizontal segment of the casting line, which normally coincides with the rolling plane, and delivers the product to a station 107 for shearing to size and to successive processing stations.

The overall height "l" of the casting line to the rolling plane is about 10400 to 11800 mm.

The present continuous vertical casting technologies for the production of slabs provide for bringing the solidification of the product 108 to a very high value before the end, or at about the end, of the containing and guide assemblies 103.

In this way there is a sharp reduction of the risk of bulging of the skin of the slab 108 owing to the inclusion of a free segment of a height "d" of about 300 to 500 mm. between the containing and guide assemblies 103 and the extraction assembly 105, and to the action of the rolls of the extraction assembly 105 on the slab 108 and to the hydrostatic pressure exerted by the liquid core.

The continuous casting machines of the state of the art, such as the machine 100 of FIG. 1, do not provide for the position of the kissing point, namely the zone where the two solidified skins begin to weld themselves to each other, to be able to be made variable and to be conditioned in a desired manner by a controlled variation of the casting parameters.

In such machines of the state of the art the position of the kissing point is the natural one and depends substantially on the type of steel cast, so that, given equal materials cast, the kissing point is located at about a substantially fixed point.

Instead, the present applicants have ascertained for some time now (see EP-A-0625388) that, so as to have a good quality of cast product, particularly with thin slabs, it is necessary that the longitudinal position of the kissing point can be made variable, even continuously, by controlling and possibly altering continuously the casting parameters.

In this way, depending on the type of steel cast, it is possible to vary the longitudinal position of the kissing point so as to achieve the best result.

EP-A-0625388 teaches also the adjustment of the position and the speed of the rolls of the containing and guide assemblies 103 according to the continuously monitored casting parameters in order to obtain a controlled prerolling, or soft reduction, of the slab, thus exploiting the inclusion of the liquid core and the characteristics of plasticity of the solidified skin being formed.

This feature of the method not only ensures operational advantages in the structure of the crystalliser and discharge nozzle as shown in the above document but also enables a refining of the structure of solidification of the metal and the elimination of the central segregation in the slab to be achieved.

Moreover, the versatility of the machine is increased considerably and the extraction speeds which can be achieved can be much greater.

However, this result entails an optimum length of soft reduction, as measured from the outlet of the mould, and this length has to be calculated on each occasion and can take on great values sometimes.

As we said, the kissing point in the embodiments of the state of the art has, instead, to remain within the containing and guide assemblies 103 or, at the most, to be immediately therebelow, thus limiting strongly the versatility of the plant and the extraction speed.

SUMMARY OF THE INVENTION

The present applicants have designed and tested this invention to overcome these shortcomings of the most developed state of the art of continuous vertical casting and to achieve further advantages.

The purpose of the invention is to embody a vertical continuous casting line for slabs, and in particular for thin and medium sized slabs, in which it is possible to achieve a great versatility of the plant and a high extraction speed, and therefore a high output of the plant, and to obtain at the same time a good internal and surface quality of the product.

Another purpose is to embody the improved vertical casting line without altering the conformation and arrangement of the majority of the elements constituting the continuous vertical casting machine, thus making the adoption of the line according to the invention advantageous in terms of investment too.

This improved vertical casting line can therefore be incorporated in any pre-existing plant without major structural changes or difficult adaptations.

According to the invention the containing and guide assemblies having the task of possible controlled prerolling and therefore of soft reduction of the slab leaving the mould take up at least the whole vertical segment of the casting line.

In this case, according to the invention, the kissing point can be displaced longitudinally as desired along the whole vertical segment of the line and also therebeyond, depending on the type of steel cast and the other processing parameters.

According to the invention the position of the extraction assembly is lowered so as to cooperate at least with the beginning of the curve which the slab carries out to arrive from the vertical casting plane to the horizontal rolling plane.

This ensures for the cast product a long space and therefore a long time to complete the solidification process before coming into cooperation with the gripping rolls of the extraction assembly.

By means of the soft reduction, which is carried out at least in the second vertical segment of the casting line, but advantageously along the whole vertical part, the thickness of the cast product is progressively reduced by making use advantageously of the presence of the liquid core, which makes possible the use of limited rolling forces which can be supported by the rolls of a small diameter of the containing and guide assemblies.

According to the invention the kissing point can be displaced as desired as far as the outlet from the last containing and guide assembly, so that the product coming into cooperation with the extraction assembly positioned at least at the beginning of the curvature will have a stable and strong enough internal structure to obviate the bulging and deformation effects caused by contact with the extraction rolls.

Moreover, according to the invention the rolls of the last containing and guide assembly are located at a position extremely near to the first extraction roll, so that no relaxation of the solidified skin nor surface deformations or tensions are permitted up to the moment of the departure of the cast product from the last containing and guide assembly.

According to a variant the extraction assembly is replaced by a plurality of containing and guide assemblies arranged along the whole arc of the curve followed by the product substantially up to the vicinity of the drawing assembly placed horizontally on the rolling plane.

This makes possible a further prolongation of the solidification process with a resulting greater versatility of the plant.

In fact, this situation enables the kissing point to be moved to a desired long zone immediately upstream of the horizontal drawing assembly and a desired controlled soft reduction to be carried out on the cast product.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
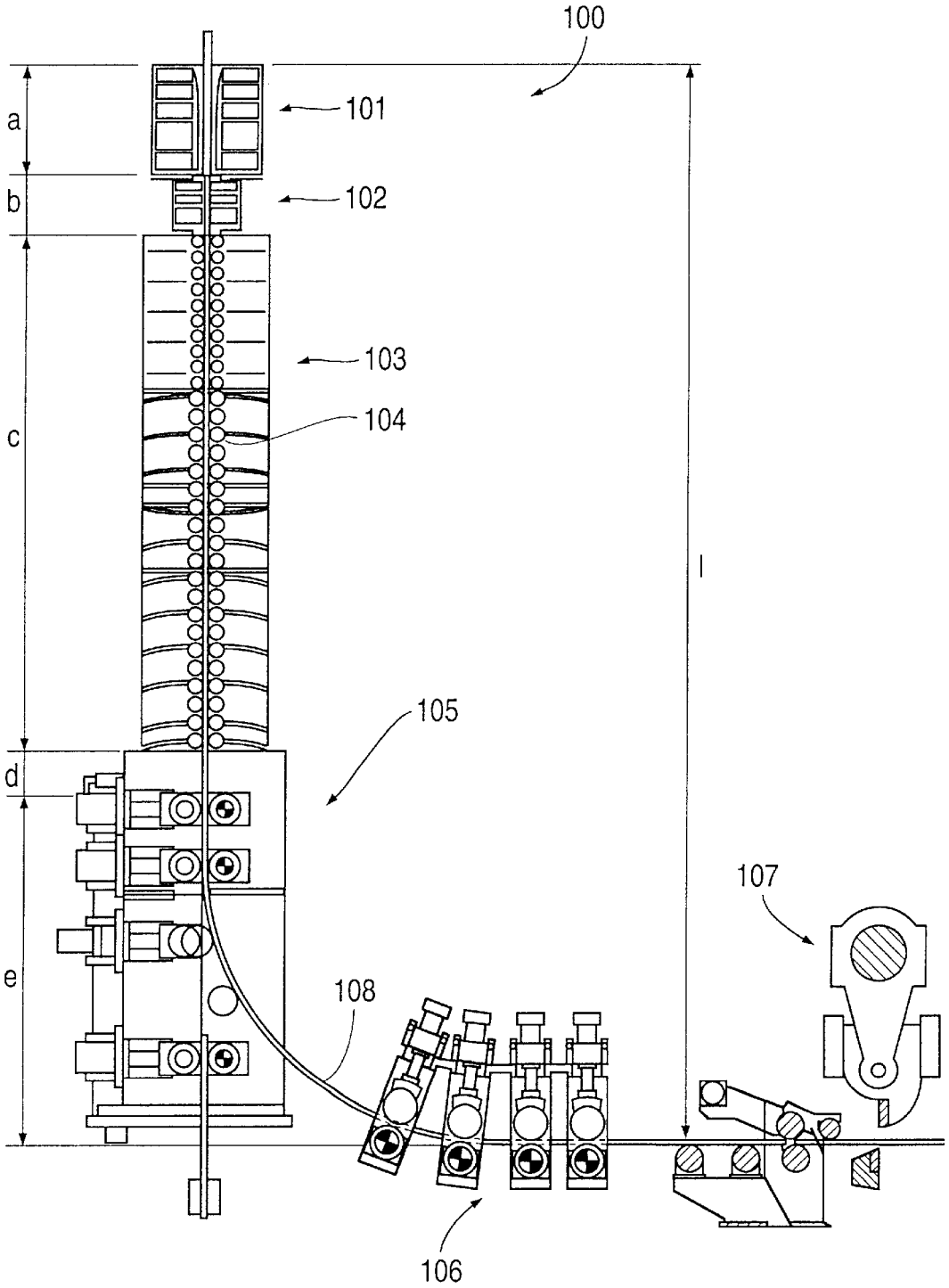
FIG. 1 shows a continuous vertical casting line for slabs of the state of the art.
Figure 3:
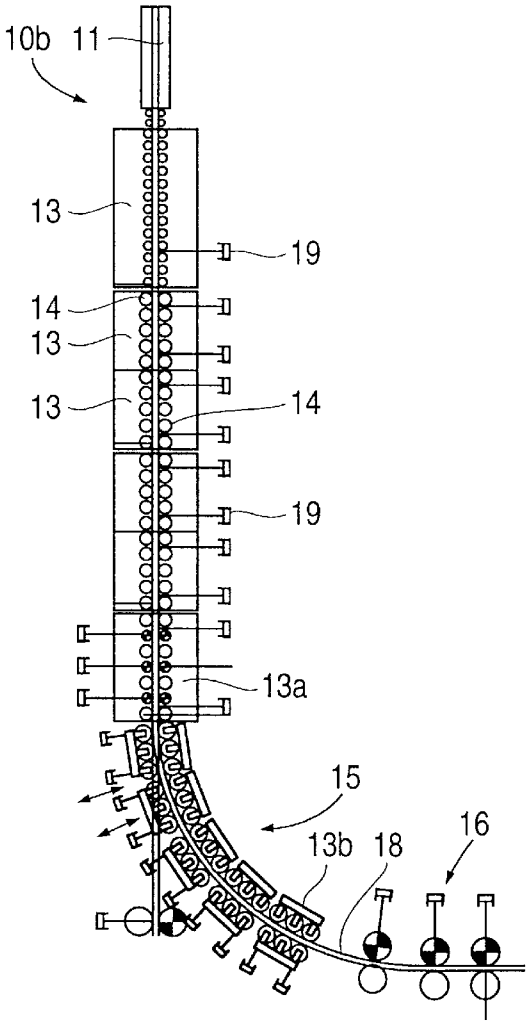
FIG. 3 shows a variant of FIG. 2.
Figure 2:
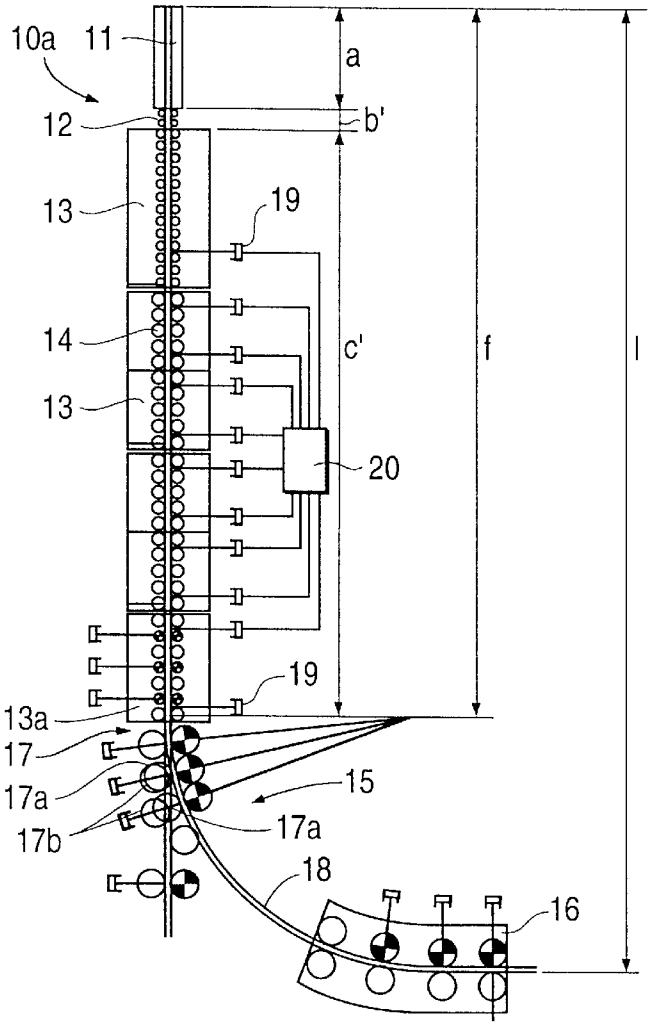
FIG. 2 shows a first embodiment of the continuous vertical casting line for slabs according to the invention.

Continuous casting machines 10*a* and 10*b* shown in FIGS. 2 and 3 have an extent of height "l" of a value of about 10800 to 11800 mm., which can be compared substantially to that of the continuous casting machine 100 of the state of the art, and employ a mould 11 which can be wholly analogous to the mould 101 of FIG. 1.

According to the invention a foot roll assembly 12 having a very modest height "b" of about 150 to 250 mm. is included downstream of the mould 11.

The foot roll assembly 12 can be replaced by plates, strips, or other analogous containing elements.

A plurality of containing and guide assemblies 13, the rolls 14 of which limit a slab 18 laterally during its descent and exert at the same time a controlled pre-rolling action (soft reduction) at least along the second vertical segment of the casting line, is included immediately downstream of the foot roll assembly 12.

So as to perform this task, the rolls 14 of the assemblies 13 cooperate individually or in groups with actuation means 19 governed by a data processing unit 20 (shown for the sake of convenience in FIG. 2 only), which controls continuously the casting parameters and adjusts the positions and speeds of the rolls 14 in relation to the slab 18.

This data processing unit 20 can also perform other tasks relating to the control of the continuous casting method, such as, for instance, the coordination between the working of the mould 11 and the actuation of the rolls 14, the governing of the position of the containing and guide assemblies 13 by the type of material cast, the continuously monitored temperatures, the speed of extraction, etc.

The containing and guide assemblies 13 cooperate with secondary cooling systems, which are not shown here but assist the progressive completion of the solidification process.

In the example of FIG. 2 the containing and guide assemblies extend along a height "c'" of about 6800 to 7200 mm. so as to cover substantially the whole vertical segment having a height "f" of about 8000 to 8800 mm; of the casting line 10*a* .

In fact, the extraction assembly 15 is positioned at least beyond the zone of the beginning of the arc of a circumference followed by the slab 18 in moving from the vertical casting position to the horizontal rolling position.

The last containing and guide assembly 13*a* has its rolls 14 extending to a position extremely near the rolls 17 of the extraction assembly 15.

The position of the kissing point may be extended in this way along all the containing and guide assemblies 13, that is to say, along the whole vertical part of the casting line.

In other words, the position of the kissing point can be varied as desired in relation to identification of its best value at least along the whole vertical part of the casting line and also in a zone immediately beyond that vertical part.

The liquid core within the slab 18 is always controlled since the rolls 14 exert a limited and substantially continuous pressure inasmuch as the very limited space between the engagement surface of one roll 14 and that of the next roll 14 does not allow the solidified skin to become deformed or to bulge under the thrust of that liquid core.

The lowering of the extraction assembly 15 provides the slab 18 with an ample zone to carry out the progressive solidification process before coming into cooperation with the rolls 17 of the extraction assembly 15.

In this case the extraction rolls 17 have a first casting position 17*a* and a second position 17*b* for extraction of the starter bar and/or for sampling.

In the final segment of the curvature of the trajectory performed by the slab 18 is included a drawing assembly 16, which sends the slab 18 for shearing and to the successive processing stations.

According to the variant shown in FIG. 3 there is a plurality of containing and guide assemblies 13*b* which accompany the slab 18 along the whole arc of the circumference travelled to reach a horizontal position. This embodiment enables the position of the kissing point to be displaced to the vicinity of the drawing assembly 16.

This situation is possible since the containing and guide assemblies 13*b*, having a structure substantially analogous to that of the containing and guide assemblies 13, can act on the slab 18 still containing a liquid core without entailing the shortcomings mentioned above.

With this embodiment the versatility of the plant can be considerably increased and the soft reduction can be made more effective since it is spread along a very extended zone.

We claim:

1. A casting line for casting a slab, which comprises a mould, an assembly of containing elements located at the outlet of the mould, a plurality of containing and guide assemblies provided immediately downstream of the assembly of containing elements and comprising a plurality of pairs of rolls associated with a vertical segment of the line, a drawing assembly associated with a horizontal segment of the line, wherein the containing and guide assemblies cover at least the whole vertical segment of the casting line downstream of the assembly of containing elements, and actuation means governed by a data processing unit for adjusting at least the position of the rolls of the containing and guide assemblies with respect to the slab to obtain a controlled pre-rolling at least in the downstream part of the vertical segment of the casting line.

2. Casting line as in claim 1, further comprising an extraction assembly, and wherein the last element of the last containing and guide assembly is immediately adjacent to the first element of the extraction assembly.

3. Casting line as in claim 1, in which the containing and guide assemblies extend to the vicinity of the drawing assembly.

4. Casting line as in claim 1, in which the rolls of the containing and guide assemblies carry out a controlled pre-rolling along the whole vertical segment of the casting line.

5. Casting line as in claim 4, further comprising an extraction assembly, and wherein the last element of the last containing and guide assembly is immediately adjacent to the first element of the extraction assembly.

* * * * *